United States Patent [19]

Nakajima et al.

[11] Patent Number: 4,815,945

[45] Date of Patent: Mar. 28, 1989

[54] VARIABLE CAPACITY VANE COMPRESSOR

[75] Inventors: Nobuyuki Nakajima; Kenichi Inomata; Masaya Moruta; Toshio Yamaguchi; Kazuo Eitai, all of Konan, Japan

[73] Assignee: Diesel Kiki Co., Ltd., Tokyo, Japan

[21] Appl. No.: 196,318

[22] Filed: May 20, 1988

[30] Foreign Application Priority Data

Jul. 31, 1987 [JP] Japan ..... 62-193274
Sep. 22, 1987 [JP] Japan ..... 62-239268

[51] Int. Cl.[4] ..... F04B 49/02; F04C 29/08
[52] U.S. Cl. ..... 417/295; 417/310
[58] Field of Search ..... 417/295, 310, 440; 418/15

[56] References Cited

U.S. PATENT DOCUMENTS 4,060,343 11/1977 Newton ..... 417/310
4,726,740 2/1988 Suzuki et al. ..... 417/295
4,737,081 4/1988 Nakajima et al. ..... 417/295
4,744,732 5/1988 Nakajima et al. ..... 418/15

FOREIGN PATENT DOCUMENTS 62-129593 6/1987 Japan .

*Primary Examiner*—William L. Freeh
*Attorney, Agent, or Firm*—Frishauf, Holtz, Goodman & Woodward

[57] ABSTRACT

A variable capacity vane compressor has a cylinder including a cam ring having an inner peripheral surface with an oblong cross section and within which a rotor is rotatably received, a plurality of vanes carried by the rotor, and a control plate disposed in the cylinder for rotation in opposite circumferential directions and having a peripheral edge formed with at least one cut-out portion. The control plate is disposed to rotate in response to a difference between pressure from a lower pressure zone and pressure from a higher pressure zone to cause a change in the circumferential position of the cut-out portion, thereby varying the compression commencing timing of the compressor and hence the capacity of same. The cut-out portion of the control plate comprises a first portion circumferentially extending from a downstream end of the cut-out portion with respect to the direction of rotation of the rotor to an intermediate portion of the same, and a second portion circumferentially extending from the intermediate portion to an upstream end of the cut-out portion, and being shallower than the first portion. The cut-out portion has such a circumferential position and length that the second portion is positioned radially inwardly of the inner peripheral surface of the cam ring and has an upstream end and a downstream end thereof positioned, respectively, upstream of a downstream end of an inlet port formed in the cylinder and downstream of same, when the control plate member is circumferentially displaced to an extreme circumferential position in which the minimum capacity of the compressor is obtained, whereby unnecessary compression is prevented.

4 Claims, 4 Drawing Sheets

VARIABLE CAPACITY VANE COMPRESSOR

BACKGROUND OF THE INVENTION

This invention relates to variable capacity vane compressors which are suitable for use as refrigerant compressors of air conditioners for automotive vehicles.

There are known variable capacity vane compressors which are capable of controlling the capacity of the compressor by varying the suction quanitity of a gas to be compressed. As one of such vane compressors a variable vane compressor is known e.g. by Japanese Provisional Patent Publication (Kokai) No. 62-129593, which is provided with a cam ring c having an inner peripheral surface with an elliptical cross section which forms a chamber b accommodating therein a rotor a with a circular cross section, as shown in FIG. 1, and an angularly movable control plate f having its outer peripheral edge formed with diametrically opposite arcuate cut-out portions e, e communicating inlet ports d, d to compression chambers h, h, respectively, as shown in FIG. 1. The control plate f is disposed to move in circumferential opposite directions in response to a difference between pressure on a lower pressure side and pressure on a higher pressure side, to vary the circumferential positions of the cut-out portions e, e, thereby controlling the capacity or delivery quantity of the compressor. During the operation of the above compressor, a refrigerant gas to be compressed is sucked from each inlet port d into a space defined between adjacent vanes g, g, as the volume of a compression chamber h is increased during a suction stroke thereof, in accordance with the rotation of the rotor a in a counter-clockwise direction as viewed in FIG. 1, and then the sucked gas is compressed, as the volume of the compression chamber h is reduced during a compression stroke thereof. Then the compressed gas is discharged from an outlet port j. When the control plate f is displaced to an extreme circumferential position in which the maximum capacity of the compressor is obtained, i.e. in the clockwise direction as viewed in FIG. 1, opposite ends e1, e2 of each cut-out portion e are aligned with respective opposite ends d1, d2 of the corresponding inlet port d, whereby the compression of the refrigerant gas is commenced at a point A shown in FIG. 1 to achieve maximum or full capacity operation. On the other hand, when the control plate f is displaced to an opposite extreme circumferential position in which the minimum capacity of the compressor is obtained, i.e. in the counter-clockwise direction as viewed in FIG. 1, the opposite ends e1, e2 of each cut-out portion e are positioned on a downstream side of the downstream end d1 of the inlet port d, with respect to the rotational direction of the rotor a, whereby the compression of the refrigerant gas is commenced at a point B shown in FIG. 2 to achieve minimum capacity operation.

During the minimum capacity operation, the upstream end e2 is positioned on a downstream side of the downstream end d1 of the inlet port d, apart therefrom by a distance L. As a result, compression of the gas is effected at the portion L during high speed rotation of the compressor. More specifically, the gas cannot laterally escape while it travels along the distance L, and when having passed the distance L, it is prevented from leaking into a lower pressure side through the cut-out portion e by the inertia force of the gas flow due to rotational high speed of the compressor. The compression of the gas over the distance L is unnecessary or superfluous and undesirable because it causes resistance of the compressed gas against the rotation of the vane g of the rotor a. If the cut-out portion e is prolonged so that its upstream end e2 becomes closer to the downstream end d1 of the inlet port d, in order to avoid the above unnecessary compression, the compression chamber h on the suction stroke is disadvantageously communicated with the compression chamber h on the discharge stroke, which is located on an upstream side of the compression chamber on the suction stroke, through the prolonged cut-out portion e during the full capacity operation of the compressor.

SUMMARY OF THE INVENTION

It is an object of the invention to provide a variable capacity vane compressor in which unnecessary compression is prevented at minimum capacity operation to thereby eliminate resistance of the compressed gas against the rotatin of the vanes of the rotor.

According to the present invention, there is provided a variable capacity vane compressor having a cylinder including a cam ring having an inner peripheral surface with an oblong cross section and having a largest-diameter portion and a smallest-diameter portion, and within which a cylindrical rotor is rotatably received, a plurality of vanes carried by the rotor, at least one inlet port formed in the cylinder in the vicinity of the largest-diameter portion, a control plate member disposed in the cylinder for rotation about an axis thereof in opposite circumferential directions and having an end face thereof kept in contact with respective end faces of the rotor and the vanes, the control plate member having an outer peripheral edge thereof formed with at least one cut-out portion, a lower pressure zone, a higher pressure zone, and means for rotating the control plate member in response to a difference between pressure from the lower pressure zone and pressure from the higher pressure zone, the rotation of the control plate member causing a change in the circumferential position of the cut-out portion to thereby vary the compression commencing timing of the compressor and hence vary the capacity of the compressor.

The variable capacity vane compressor according to the invention is characterized by the improvement wherein: the cut-out portion of the control plate member comprises a first portion circumferentially extending from a downstream end of the cut-out portion with respect to the direction of rotation of the rotor to an intermediate portion of same, and a second portion circumferentially extending from the intermediate portion to an upstream end of the cut-out portion, the second portion being smaller in depth than the first portion, the at least one cut-out portion having such a circumferential position and length that the second portion is positioned readilly inwardly of the inner peripheral surface of the cam ring and has an upstream end and a downstream end thereof positioned, respectively, upstream of a downstream end of the inlet port and downstream of same, when the control plate member is circumferentially displaced to an extreme circumferential position in which the minimum capacity of the copressor is obtained.

The above and other objects, features and advantages of the invention will become more apparent upon reading of the following detailed description taken in conjunction with the accompanying drawings.

DETAILED DESCRIPTION

Figure 2:
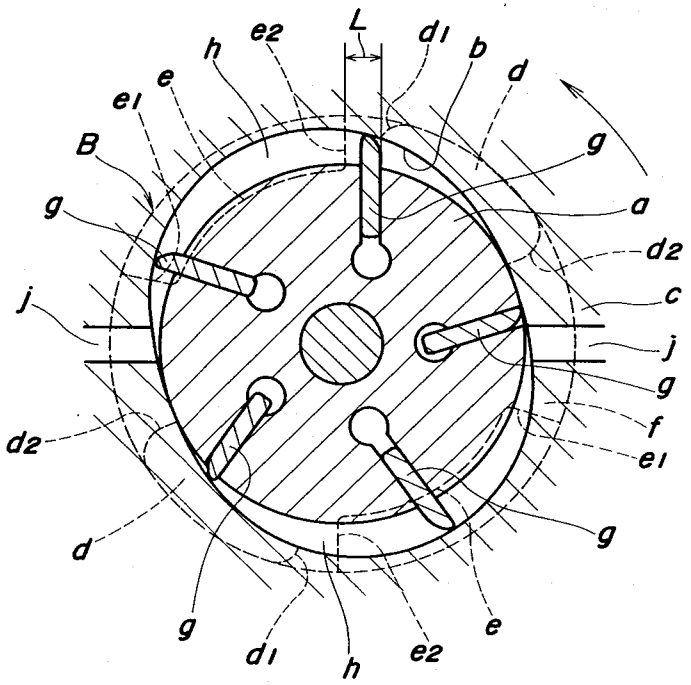
FIG. 2 PRIOR ART
FIG. 2 is a view similar to FIG. 1, showing the conventional compressor at minimum capacity operation.
Figure 1:
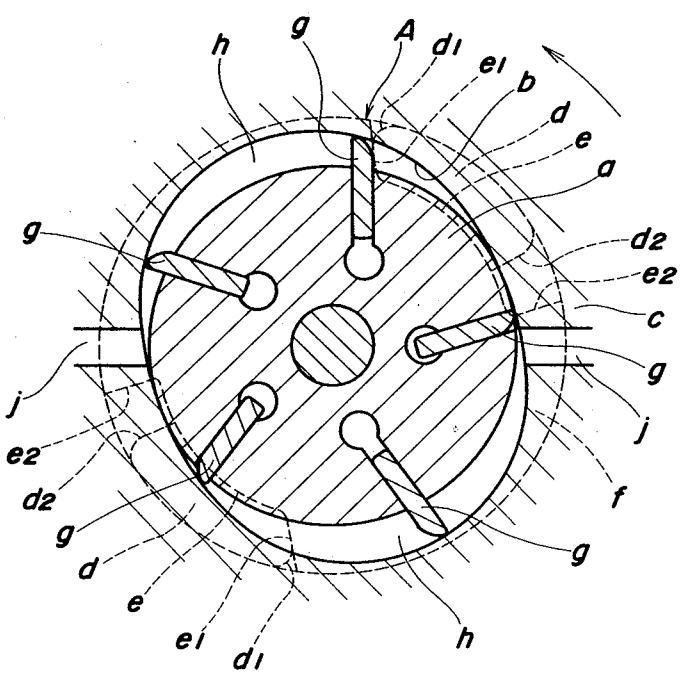
FIG. 1 PRIOR ART
FIG. 1 is a transverse cross-sectional view of an essential part of a conventional variable capacity vane compressor at full capacity operation.
Figure 3:
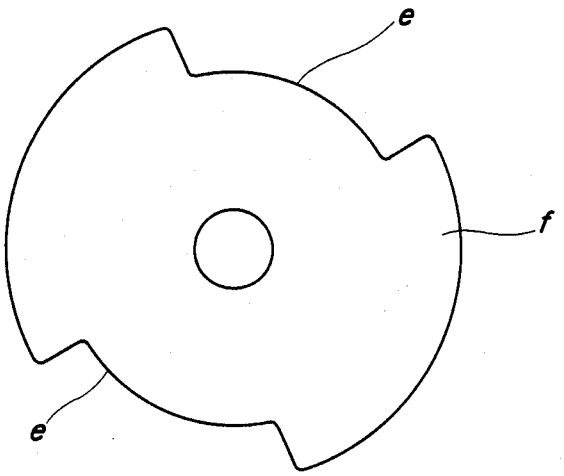
FIG. 3 PRIOR ART
FIG. 3 is a plan view of an annular control plate employed in the conventional vane compressor.

An embodiment of the present invention will now be described in detail with reference to the drawings.

FIGS. 4 through 7 show a variable capacity vane compressor according to an embodiment of the invention, wherein a pump body of the compressor is composed mainly of a cylinder formed by a cam ring 1, and a front side block 2 and a rear side block 3 closing open opposed ends of the cam ring 1, a cylindrical rotor 4 rotatably received within the cylinder, and a driving shaft 5 which is connected to an engine, not shown, of a vehicle or the like, and on which is secured the rotor 4.

A front head 6 and a rear head 7 are provided at opposite sides of the front and rear side blocks 2 and 3, respectively. A discharge port 8, through which a, refrigerant gas is to be discharged as a thermal medium, is formed in an upper portion of the front head 6, and a suction port 9, through which the refrigerant gas is to be drawn into the compressor, is formed in an upper portion of the rear head 7. The discharge port 8 and the suction port 9 communicate, respectively, with a discharge pressure chamber and a suction chamber, both hereinafter, referred to.

The driving shaft 5 is rotatably supported by a pair of radical bearings 10*a* and 10*b* provided in the side blocks 2 and 3. The driving shaft 5 extends through the front side block 5 and the front head 6 while being sealed in an airtight manner against the interior of the compressor by means of a mechanical sealing device 29 provided around the shaft 5 in the front head 6.

Figure 5:
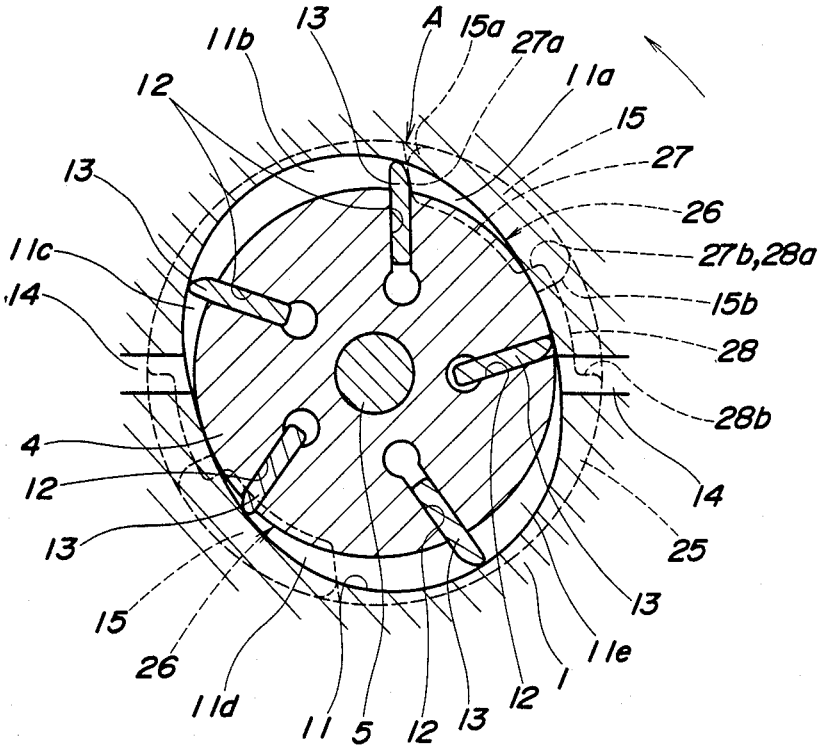
FIG. 5 is a transverse cross-sectional view of an essential part of the variable capacity vane compressor of FIG. 4 at full capacity operation.
Figure 6:
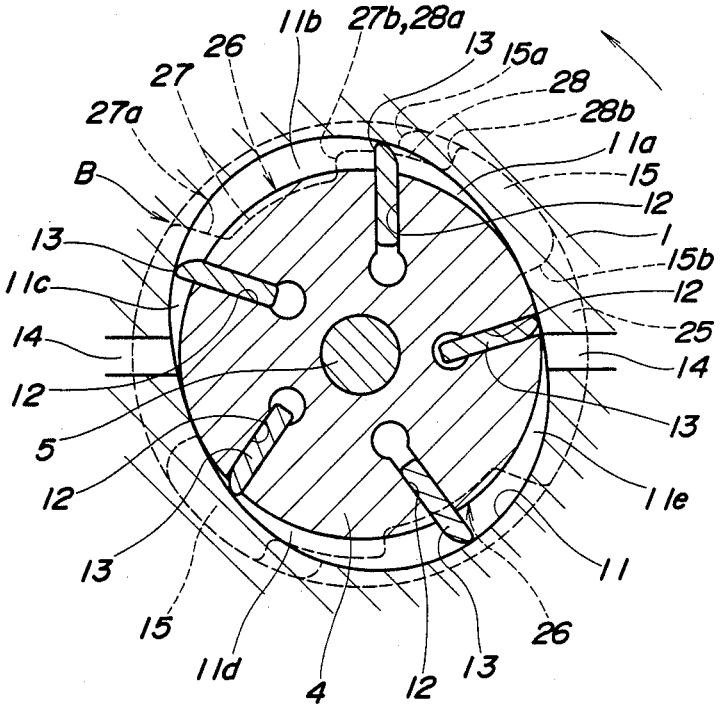
FIG. 6 is a view similar to FIG. 5, showing the compressor of FIG. 4 at minimum capacity operation.
Figure 7:
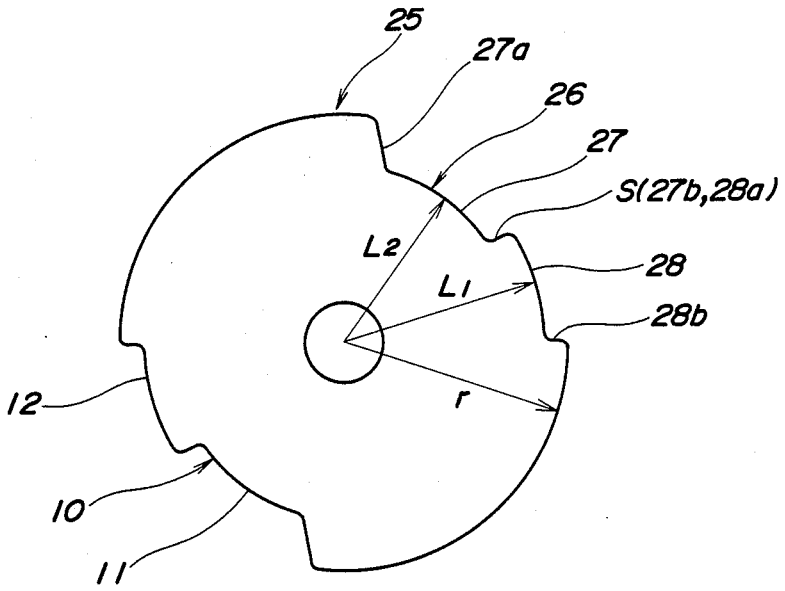
FIG. 7 is a plan view of an annular control plate employed in the compressor of FIG. 4.

The cam ring 1 has an inner peripheral surface with an oblong, e.g. elliptical cross section, as shown in FIGS. 5 and 6, and cooperates with the rotor 4 to define therebetween a pair of spaces 11 at diametrically opposite locations.

The rotor 4 has its outer peripheral surface formed with a plurality of (five in the illustrated embodiment) axial vane slits 12 at circumferentially equal intervals, in each of which a vane 13 is radially slidably fitted. Adjacent vanes 13 define therebetween five compression chambers 11*a*–11*e* within the spaces 11 in cooperation with the cam ring 1, the rotor 4, and opposed inner end faces of the front and rear side blocks 2, 3. The axial vane slits 12 open in opposite end faces of the rotor 4.

The cam ring 1 has a pair of outlet ports 14, 14 formed in an inner peripheral wall thereof at diametrically opposite smallest-diameter portions. A pair of inlet ports 15, 15 are formed in the inner end face of the rear side block 3 opposed to the cam ring 1 at diametrically opposite locations, each aligned with a portion of the cam ring 1 between the smallest-diameter portion and largest-diameter portion thereof. The suction chamber (lower pressure chamber) 17 is defined between the rear side block 3 and the rear head 7, which is communicated with the compression chambers 11*a*, 11*d* on the suction stroke, through the inlet ports 15, 15. The compression chambers 11*c*, 11*e* on the compression stroke are communicated with the discharge pressure chamber (higher pressure chamber) 18, through the outlet ports 14, 14, a recess 21, and a communicating port 23, both hereinafter referred to. The outlet ports 14, 14 are each provided with a discharge valve 19 and a stopper 20 for the discharge valve 19. The stoppers 20 are formed integrally with a cover 22 fitted on the recess 21 formed in the cam ring 1 and having circumferential arcuate grooves. The recess 21 is communicated with the discharge pressure chamber 18 through the communicating port 23.

Figure 4:
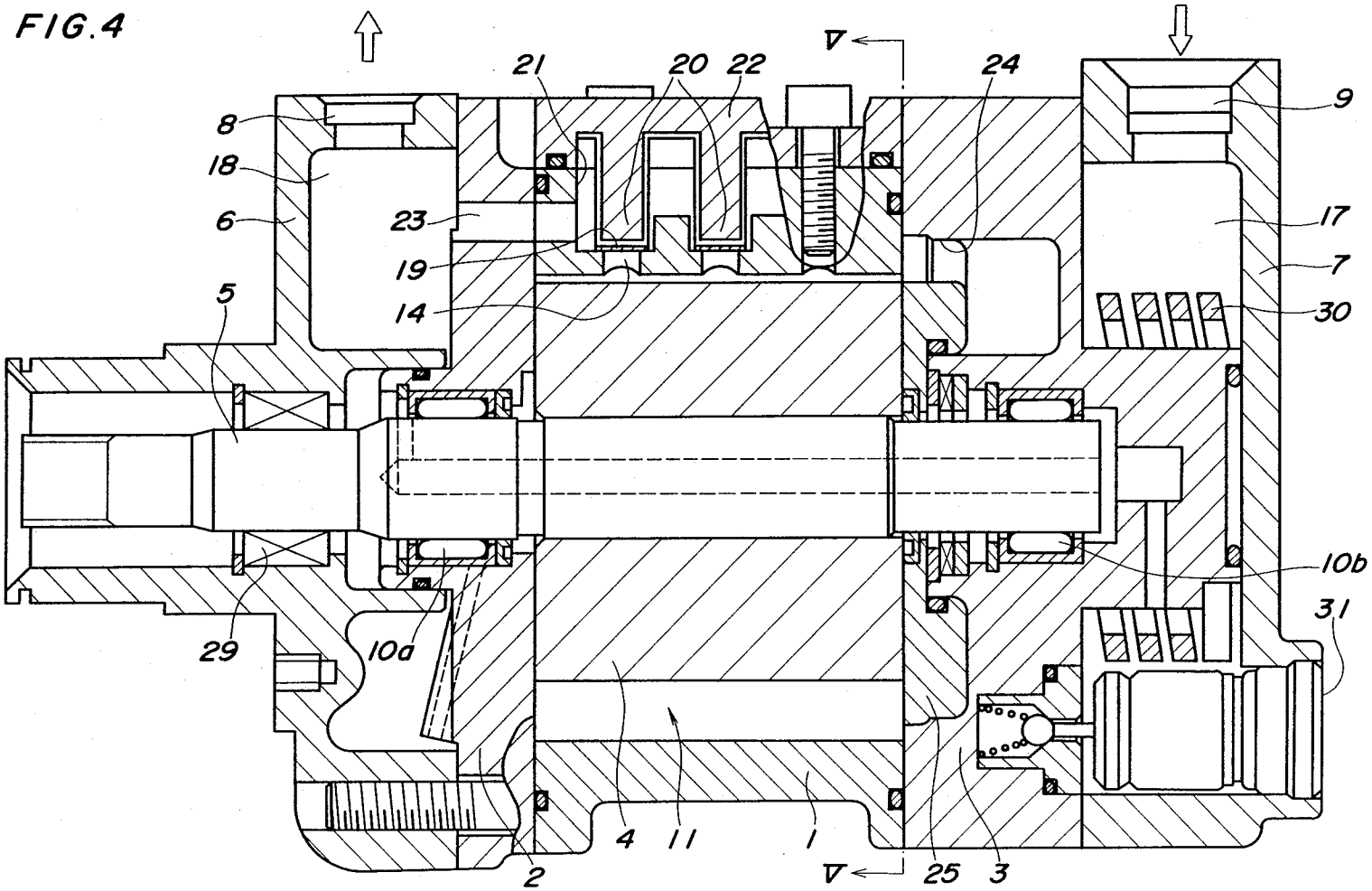
FIG. 4 is a longitudinal cross-sectional view of a variable capacity vane compressor according to the invention.

The rear side block 3 has an end face facing the rotor 4, in which is formed an annular recess 24, as shown in FIG. 4. An annular control plate 25 is received in the annular recess 24 for rotation in opposite circumferential directions. The vanes 13 and the rotor 4 have respective end faces slidably kept in contact with an opposed or inner end face of the annular control plate 25 in an airtight manner. The control plate 25 has its outer peripheral edge formed with a pair of diametrically opposite arcuate cut-out portions 26, 26, which each serve to communicate the compression chamber, which is to be on the compression stroke if the cut-out portions 26, 26 do not exist, with a lower pressure side, more specifically, with the corresponding inlet port 15 through the compression chamber on the suction stroke, so as to prevent the refrigerant gas from being compressed. Therefore, the compression is commenced immediately after the vane 13 has passed a downstream end of the cut-out portion 26. Thus, the compression commencing timing is varied with a change in the circumferential position of the cut-out portion 26, i.e. the control plate 25, thereby varying the capacity of the compressor. The control plate 25 is disposed to rotate about its own axis or the drive shaft 5 in opposite directions in response to the difference between pressure from a higher pressure zone, e.g. the discharge pressure chamber 18, and the sum of pressure from a lower pressure zone, e.g. the suction chamber 17 and the force of a coiled spring 30 circumferentially urging the control plate 25. The higher pressure zone is communicated with the lower pressure zone through a communication passage, not shown, which is opened and closed by means of a valve control device 31. The valve control device 31 is operable in response to pressure within the suction chamber 17. The arcuate cut-out portions 26, 26 have the same profile, each being composed of a first portion 27 circumferentially extending from a downstream end of the cut-out portion 26 with respect to the direction of rotation of the rotor 4 to an intermediate portion of same, and a second portion 28 circumferentially extending from the intermediate portion to the other or upstream end of the cut-out portion 26. The second portion 28 is shallower or smaller in depth than the first portion 27 with a stepped shoulder S (27*b*, 28*a*) formed between them, i.e. at the intermediate portion. In other words, a distance L1 between the bottom surface of the second portion 28 and the rotational axis of the annular control plate 25 is larger than a distance L2 between the bottom surface of the first portion 27 and the rotational axis of the control plate 25, and the distance L1 is shorter than the maximum radius r of the control plate 25. The circumferential length of each of the cut-out portions 26 is designed such that an upstream end 28*b* of the second portion 28 is positioned at least on an upstream side of a downstream end 15*a* of the inlet port 15 even when the control plate 25 is circumferentially displaced to an extreme circumferential position in which the minimum capacity of the compressor is obtained. When the control plate 25 is circumferentially displaced to an extreme circumferential position in which the maximum capacity of the compressor is obtained, opposite ends 27*a*, 27*b* of the first portion 27 are aligned, respectively, with opposite ends 15*a*, 15*b* of the inlet port 15, while the stepped shoulder S or downstream end 28*a* of the second portion 28 is aligned with the upstream end 15*b* of the inlet port 15 and simultaneously the upstream end 28*b* of the second portion 28 is aligned with the outlet port 14, as shown in FIG. 5. That is, at this time, the second portion 28 is positioned radially outwardly of the inner peripheral surface of the smallest-diameter portion of the cam ring 1. On the other hand, when the control plate 25 is circumferentially displaced to the opposite circumferential extreme portion in which the minimum capacity of the compressor is obtained, the opposite ends 27*a*, 27*b* of the first portion 27 are positioned on a downstream side of the downstream end 15*a* of the inlet port 15, while the downstream end 28*a* of the second portion 28 is positioned on a downstream side of the downstream end 15*a* of the inlet port 15 and simultaneously the upstream end 28*b* of the second portion 28 is positioned on an upstream side of the downstream end 15*a* of the inlet port 15, as shown in FIG. 6. At this time, at least part of the second portion 28 is positioned radially inwardly of the inner peripheral surface of the largest-diameter portion of the cam ring 1.

The operation of the vane compressor of the invention constructed as above will now be explained.

When pressure within the suction chamber (lower pressure chamber) 17 exceeds a predetermined value, the control valve device 31 closes the communication passage, whereby the pressure in the higher pressure zone overcomes the sum of the pressure in the lower pressure zone and the urging force of the coiled spring 30 to thereby make the control plate 25 move in such a circumferential direction as to increase delivery quantity or capacity, that is, in the clockwise direction as viewed in FIG. 6. When the control plate 25 assumes the position shown in FIG. 5, the compression is commenced when the vane 13 passes a position A, where the downstream end 27*a* of the cut-out portion 26 is aligned with the downstream end 15*a* of the inlet port 15, resulting in the maximum delivery quantity (full capacity operation).

On the other hand, when the pressure within the suction chamber 17 decreases below the predetermined value, the control valve device 31 opens the communication passage, whereby the pressure in the higher pressure zone leaks through the open communication passage into the lower pressure zone and consequently the pressure in the higher pressure zone is decreased, thereby making the control plate 25 move in such a circumferential direction as to decrease the delivery quantity, that is, in the counter-clockwise direction in FIG. 5. When the control plate 25 assumes the position shown in FIG. 6, the compression is commenced when the vane 13 passes a position B or the downstream end 27*a* of the cut-out portion 26, resulting in the minimum delivery quantity (minimum capacity operation).

During the minimum capacity operation, the upstream end 28*b* of the second portion 28 of the cut-out portion 26 is positioned on an upstream side of the downstream end 15*a* of the inlet port 15. Therefore, part of refrigerant gas which is pushed by the vane 13 moving along the second portion 28 leaks through a gap between the second portion 28 and the annular recess 24 to thereby prevent unnecessary compression of the gas, which reduces resistance of the compressed gas against the rotation of the vanes 13 of the rotor 4.

Incidentally, since the upstream end 28*b* of the cut-out portion 26 is positioned radially outwardly of the inner peripheral surface of the smallest-diameter portion of the inner peripheral surface of the cam ring 1 during the full capacity operation of the compressor, the compression chamber on the suction stroke is not communicated with the compression chamber on the discharge stroke, which is located on the upstream side of the compression chamber on the suction stroke, through the cut-out portion 26.

What is claimed is:

1. In a variable capacity vane compressor having a cylinder including a cam ring having an inner peripheral surface with an oblong cross section and having a largest-diameter portion and a smallest-diameter portion, and within which a cylindrical rotor is rotatably received, a plurality of vanes carried by said rotor, at least one inlet port formed in said cylinder in the vicinity of said largest-diameter portion, a control plate member disposed in said cylinder for rotation about an axis thereof in opposite circumferential directions and having an end face thereof kept in contact with respective end faces of said rotor and said vanes, said control plate member having an outer peripheral edge thereof formed with at least one cut-out portion, a lower pressure zone, a higher pressure zone, and means for rotating said control plate member in response to a difference between pressure from said lower pressure zone and pressure from said higher pressure zone, the rotation of said control plate member causing a change in the circumferential position of said cut-out portion to thereby vary the compressin commencing timing of the compressor and hence vary the capacity of the compressor, the improvement wherein: said cut-out portion of said control plate member comprises a first portion circumferentially extending from a downstream end of said cut-out portion with respect to the direction of rotation of said rotor to an intermediate portion of same, and a second portion circumferentially extending from said intermediate portion to an upstream end of said cut-out portion; said second portion being smaller in depth than said first portion, said at least one cut-out portion having such a circumferential position and length that said second portion is positioned radially inwardly of said inner peripheral surface of said cam ring and has an upstream end and a downstream end thereof positioned, respectively, upstream of a downstream end of said inlet port and downstream of same, when said control plate member is circumferentially displaced to an extreme circumferential position in which the minimum capacity of the compressor is obtained.

2. A variable capacity vane compressor as claimed in claim 1, wherein said second portion of said cut-out portion is positioned radially outwardly of said inner peripheral surface of said cam ring at said smallest-diameter portion thereof, when said control plate member is circumferentially displaced to an extreme circumferential position in which the maximum capacity of the compressor is obtained.

3. A variable capacity vane compressor as claimed in claim 2, wherein said smallest-diameter portion of said cam ring has at least one outlet port formed therein, said second portion of said cut-out portion having a downstream end and an upstream end thereof with respect to the direction of rotation of said rotor, substantially aligned with an upstream end of said inlet port and said outlet port, respectively, when said control plate member is circumferentially displaced to said extreme circumferential position in which the maximum capacity of the compressor is obtained.

4. A variable capacity vane compressor as claimed in claim 2 or claim 3, wherein said first portion of said cut-out portion has opposite ends thereof substantially aligned with opposite ends of said inlet port, respectively, when said control plate member is circumferentially displaced in said extreme circumferential position in which the maximum capacity of the compressor is obtained.

* * * * *

UNITED STATES PATENT AND TRADEMARK OFFICE

CERTIFICATE OF CORRECTION

PATENT NO. : 4,815,945

DATED : March 28, 1989

INVENTOR(S) : Nakajima et al

It is certified that error appears in the above-identified patent and that said Letters Patent is hereby corrected as shown below:

Column 8, line 2 (claim 4), delete "or claim 3".

Add new claim 5 as follows:

--5. A variable capacity vane compressor as claimed in claim 3, wherein said first portion of said cut-out portion has opposite ends thereof substantially aligned with opposite ends of said inlet port, respectively, when said control plate member is circumferentially displaced to said extreme circumferential position in which the maximum capacity of the compressor is obtained.--

Signed and Sealed this

Third Day of July, 1990

*Attest:*

*Attesting Officer*

HARRY F. MANBECK, JR.

*Commissioner of Patents and Trademarks*